US006465095B1

(12) United States Patent
Dugan

(10) Patent No.: US 6,465,095 B1
(45) Date of Patent: Oct. 15, 2002

(54) SPLITTABLE MULTICOMPONENT FIBERS WITH PARTIALLY OVERLAPPING SEGMENTS AND METHODS OF MAKING AND USING THE SAME

(75) Inventor: Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 09/669,440

(22) Filed: Sep. 25, 2000

(51) Int. Cl.[7] ..... D01F 8/00
(52) U.S. Cl. ..... 428/373; 428/370; 428/374
(58) Field of Search ..... 428/370, 373, 428/374, 397

(56) References Cited

U.S. PATENT DOCUMENTS

| | | | | |
|---|---|---|---|---|
| 3,418,200 | A | | 12/1968 | Tanner |
| 3,700,544 | A | | 10/1972 | Matsui |
| 4,073,988 | A | | 2/1978 | Nishida et al. |
| 4,239,720 | A | | 12/1980 | Gerlach et al. |
| 4,241,122 | A | | 12/1980 | Asano |
| 4,364,983 | A | | 12/1982 | Brücher et al. |
| 4,381,335 | A | | 4/1983 | Okamoto |
| 4,460,649 | A | | 7/1984 | Park et al. |
| 4,496,619 | A | | 1/1985 | Okamoto |
| 4,956,236 | A | | 9/1990 | Wang |
| 4,999,243 | A | | 3/1991 | Maeda |
| 5,354,617 | A | | 10/1994 | Ikkanzaka et al. |
| 5,458,972 | A | * | 10/1995 | Hagen ..... 428/373 |
| 5,464,695 | A | | 11/1995 | Kawamoto et al. |
| 5,487,944 | A | | 1/1996 | Ikkanzaka et al. |
| 5,593,778 | A | | 1/1997 | Kondo et al. |
| 5,688,582 | A | | 11/1997 | Nagaoka et al. |
| 5,759,926 | A | | 6/1998 | Pike et al. |
| 5,783,503 | A | | 7/1998 | Gillespie et al. |
| 5,840,633 | A | | 11/1998 | Kurihara et al. |
| 5,948,528 | A | | 9/1999 | Helms, Jr. et al. |
| 5,981,408 | A | | 11/1999 | Nakagawa et al. |

* cited by examiner

*Primary Examiner*—Newton Edwards
(74) *Attorney, Agent, or Firm*—Alston & Bird LLP

(57) ABSTRACT

Splittable multicomponent fibers which include polymer segments of different polymeric compositions, in which at least one segment partially overlaps an adjacent segment at the surface of the fiber so as to partially occlude or encapsulate the adjacent segment. The multicomponent fibers of the present invention may be mechanically split into microfilaments formed entirely of the respective components. The fibers of the present invention may be used in a variety of textile applications.

21 Claims, 9 Drawing Sheets

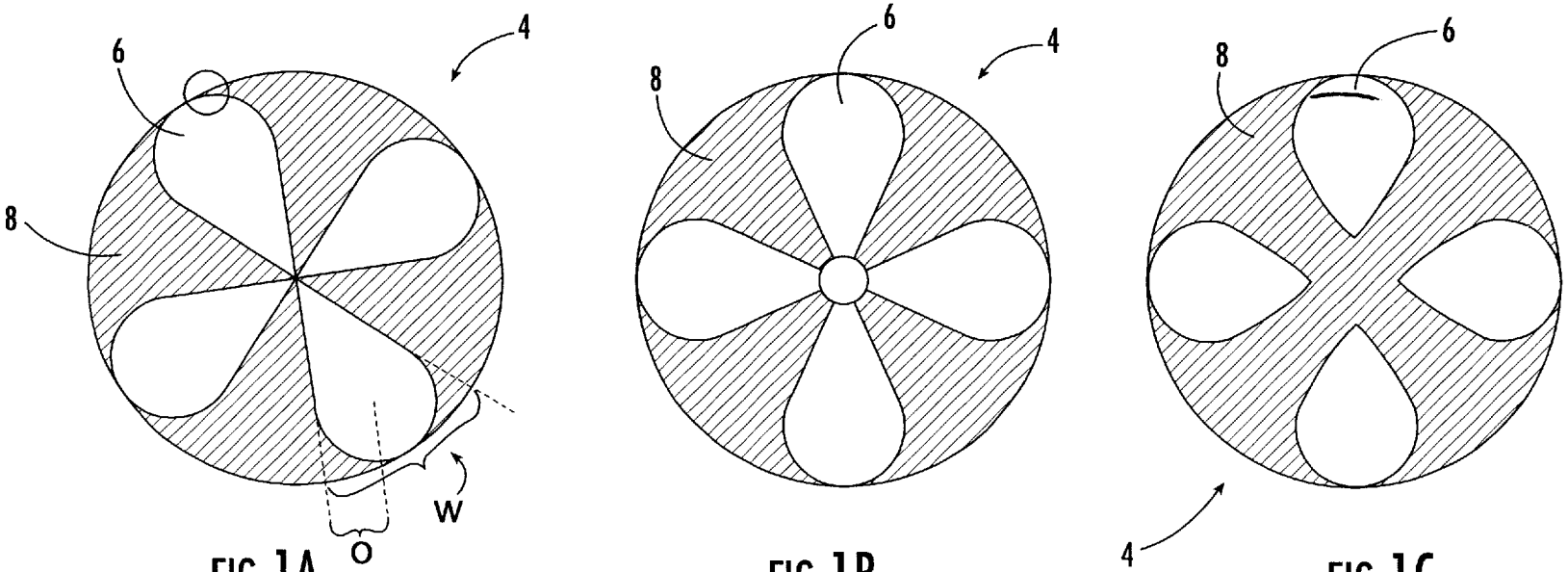
FIG. 1A.
FIG. 1B.
FIG. 1C.
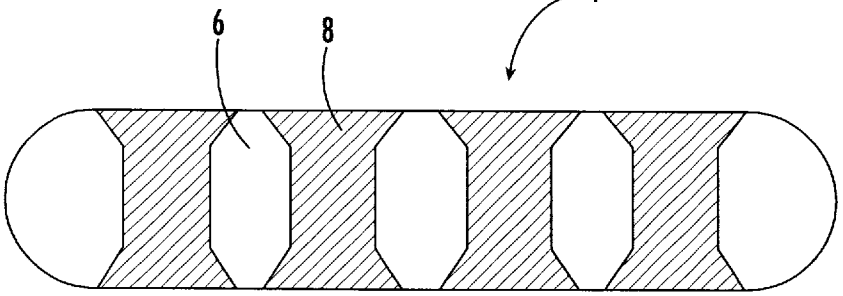
FIG. 1D.
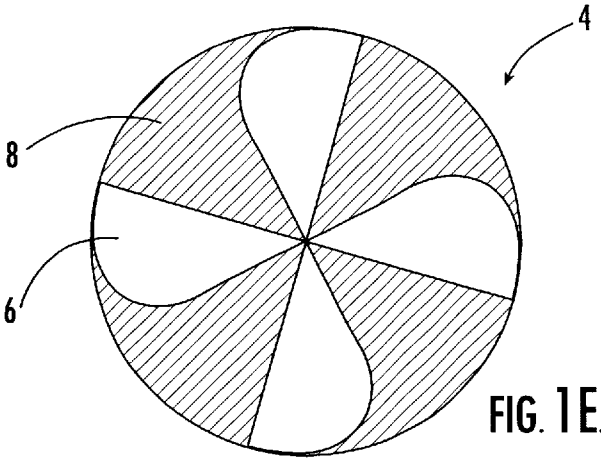
FIG. 1E.

SPLITTABLE MULTICOMPONENT FIBERS WITH PARTIALLY OVERLAPPING SEGMENTS AND METHODS OF MAKING AND USING THE SAME

FIELD OF THE INVENTION

The present invention relates to multicomponent fiber and more particularly to multicomponent fibers having partially overlapping polymeric segments yet are mechanically dissociable or splittable.

BACKGROUND OF THE INVENTION

Multicomponent segmented fibers include at least two different polymeric components in a single fiber structure. An exemplary multicomponent segmented fiber can include alternating nylon and polyester polymer components. Multicomponent fibers (also referred to as composite fibers) can be split into their respective polymer components to form fine denier fibers, commonly referred to as microfilaments.

For example, multicomponent fibers can be split by mechanical action, such as by drawing the fibers on godet rolls, needle punching, hydroentangling, and the like. Segmented fibers split by mechanical action typically employ polymer segments forming interfaces perpendicular to the periphery of the fiber. It has heretofore been understood that such perpendicular boundaries between adjacent segments promotes fiber cleavage, i.e. prevents occlusion, by eliminating any mechanical interlocking during splitting. Further, to mechanically split the different polymer components, the polymers must be sufficiently incompatible so that the bond between the components can be broken upon mechanical action. However, polymer incompatibility should not be so great that the fiber prematurely splits, such as during the carding process.

Multicomponent fibers can also include a soluble polymer component, which can be dissolved to leave the desired microfilaments. Such multicomponent fibers typically contain polymer segments fully encapsulated in a soluble matrix. However, using a soluble matrix can also be problematic. Manufacturing yields are inherently low because a significant portion of the multicomponent fiber must be destroyed to produce the microfilaments. In addition, waste water or spent organic solvent generated by such processes can pose environmental issues. Further, time required to dissolve the matrix component out of the composite fiber can increase manufacturing inefficiencies.

To overcome these difficulties, mechanically splittable filaments have been developed which include a core polymer segment completely encapsulated by a sheath polymer. Such fibers typically do not prematurely split. However, these fibers require the use of specialized polymer systems to successfully unwrap the sheath in order to achieve the desired degree of splitting. Typically polymers suitable for use in fully wrapped fibers are brittle, and can be expensive, unsuitable for certain end-uses, difficult to extrude, or unavailable commercially.

SUMMARY OF THE INVENTION

The present invention provides uniquely shaped multicomponent fibers formed of at least two substantially insoluble polymer compositions arranged as at least three discrete polymeric segments or components. The polymeric segments or components are arranged relative to one another so that at least one segment partially overlaps or occludes at least one adjacent polymeric segment of a different polymer compositions. The partial overlap is positioned at the surface of the fiber so that both the "overlapping" segment and the "overlapped" segment have at least a portion thereof exposed at the fiber surface, i.e., the overlapping polymeric segment does not completely encapsulate the overlapped polymer segment.

Contrary to conventional thinking in the fiber industry, the inventors have found that the fibers of the invention can be readily dissociated by mechanical action, such as hydroentangling processes, despite the partial occlusion of at least one segment. In contrast to the present invention, traditional splittable multicomponent fibers include polymer segments that are non-occluded, i.e., have polymeric segments arranged relative to one another so as to form distinct unocclusive cross-sectional segments along the length of the fiber so that none of the components are physically impeded from being separated. This was believed necessary to allow the segments to readily dissociate and form microfibers. However, many useful combination of polymers, such as polyester/nylon bicomponent fibers, can prematurely split during carding operations, resulting in loss of product, production problems, lack of cardability, and the like.

One advantage of the fibers of the invention is that the fibers can withstand mechanical action subjected to fibers in many conventional processing operations, such as carding, so that the fibers remain substantially intact until directed to additional downstream processing. This can provide economies of manufacture, minimize lost product, and maintain the ability to card the fibers. The fibers can also remain intact during other fiber processing operations such as drawing, crimping, cutting and the like. However, upon application of sufficient mechanical action to the fibers, for example during a hydroentanglement process, the fibers can then readily split.

In addition the fibers of the invention are mechanically splittable. This eliminates the need to dissolve a polymeric matrix to form microfilaments, and the problems associated with such processes such as solvent disposal, manufacturing inefficiencies and the like.

The mechanically splittable multicomponent fibers of the invention can have a variety of configurations, so long as the fibers include at least one polymeric segment partially overlapping one or more adjacent polymeric segments at the surface of the fiber. Exemplary fiber cross-sectional configurations include without limitation round, oval, rectangular, and the like. Particularly advantageous fiber constructions include round fibers in which the overlapped polymeric segments have a substantially petal or leaf shaped cross-section; round fibers in the overlapping polymer segment is a matrix in which the overlapped segments are partially encapsulated; and oval or rectangular fibers in which the overlapped polymer segments have a substantially rectangular cross section.

The respective polymeric segments of the fibers can be formed of any of the types of polymers known in the art which are substantially insoluble and which can be extruded and fiberized to form fibers. This provides another advantage because conventional polymer systems that are known in the art and are readily commercially available can be used. In contrast, fibers having fully wrapped or encapsulated segments require the use of soluble polymer systems and/or exotic polymers that are not readily available commercially and may have undesirable properties (such as brittleness).

Exemplary polymers include polyolefins such as polypropylene and polyethylene, polyamides such as nylon, polyesters such as polyethylene terephthalate, elastomers, and copolymers, terpolymers and blends thereof. Preferred combinations of polymers for use in the fibers of the invention include polyester and polypropylene, polyester and polyethylene, nylon and polypropylene, nylon and polyethylene, and nylon and polyester. Thus a variety of polymer combinations are available for use in this invention without the concerns associated with conventional bicomponent fiber constructions for the same combination of polymers, such as premature splitting.

The multicomponent fibers can be mechanically treated, for example by hydroentanglement or needlepunching, to effect dissociation of the polymeric components to form a plurality of uniquely shaped microfilaments. The resultant microfilaments take on the shape of the precursor polymeric segments.

Other aspects of the invention include fabrics formed of the mechanically divisible multicomponent fibers which include partially overlapping polymer segments, fabrics in which the fibers have been dissociated so as to provide a plurality of uniquely shaped microfilaments, and methods by which to produce such fabrics. In these aspects of the invention, the multicomponent fibers can be divided into microfilaments either prior to, during, or following fabric formation. Fabrics of the present invention may generally be formed by weaving, knitting, or nonwoven processes. Advantageously the fabric is a dry-laid nonwoven fabric, preferably bonded by hydroentangling.

Further understanding of the processes and systems of the invention will be understood with reference to the brief description of the drawings and detailed description which follows herein.

BRIEF DESCRIPTION OF THE DRAWINGS

Figure 3B:
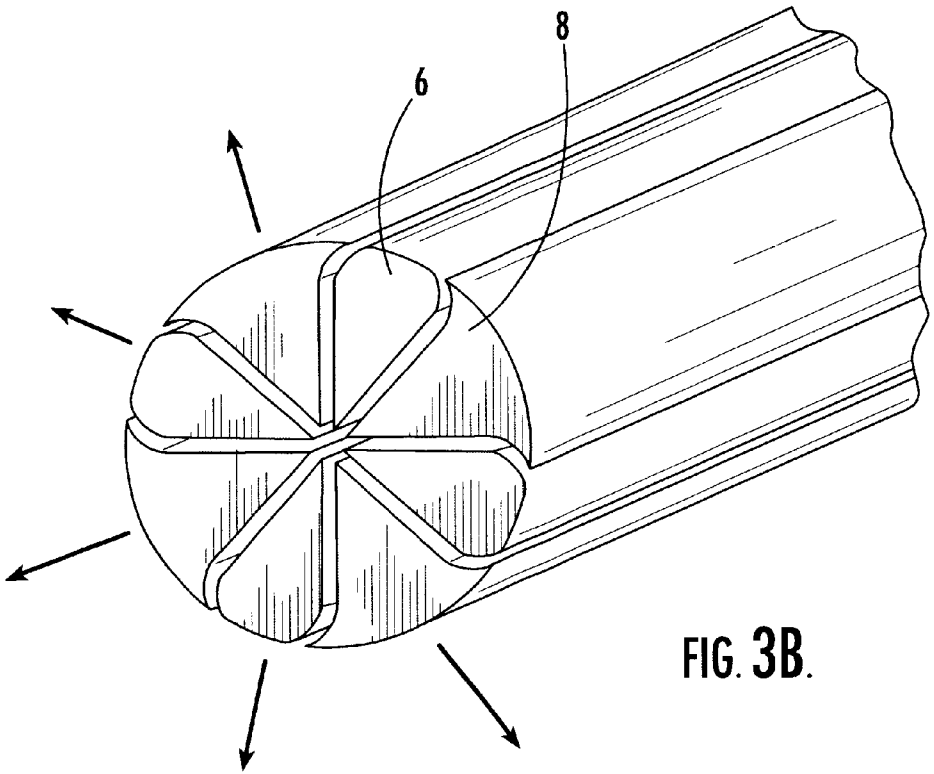
Figure 3A:
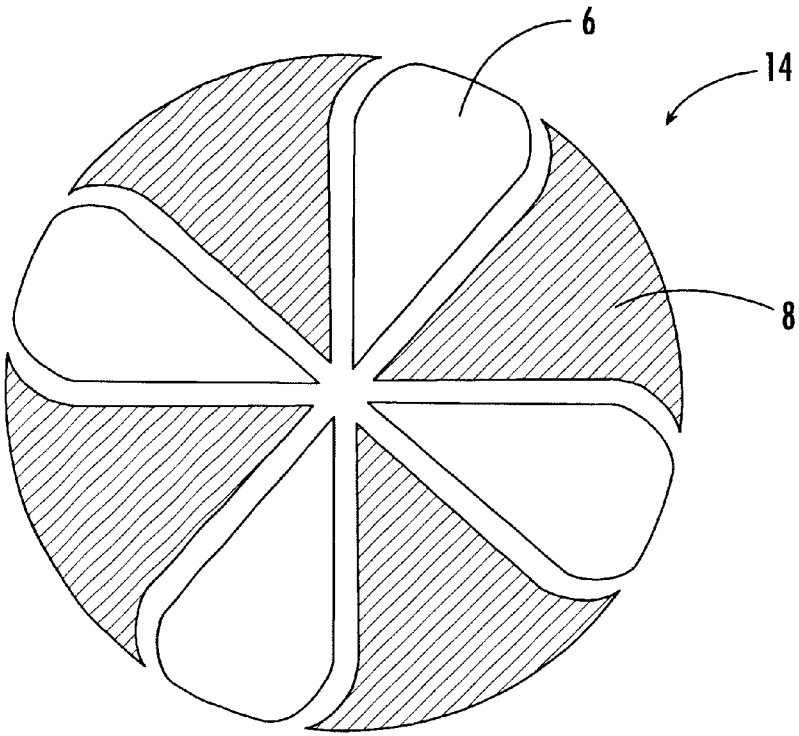
Figure 4:
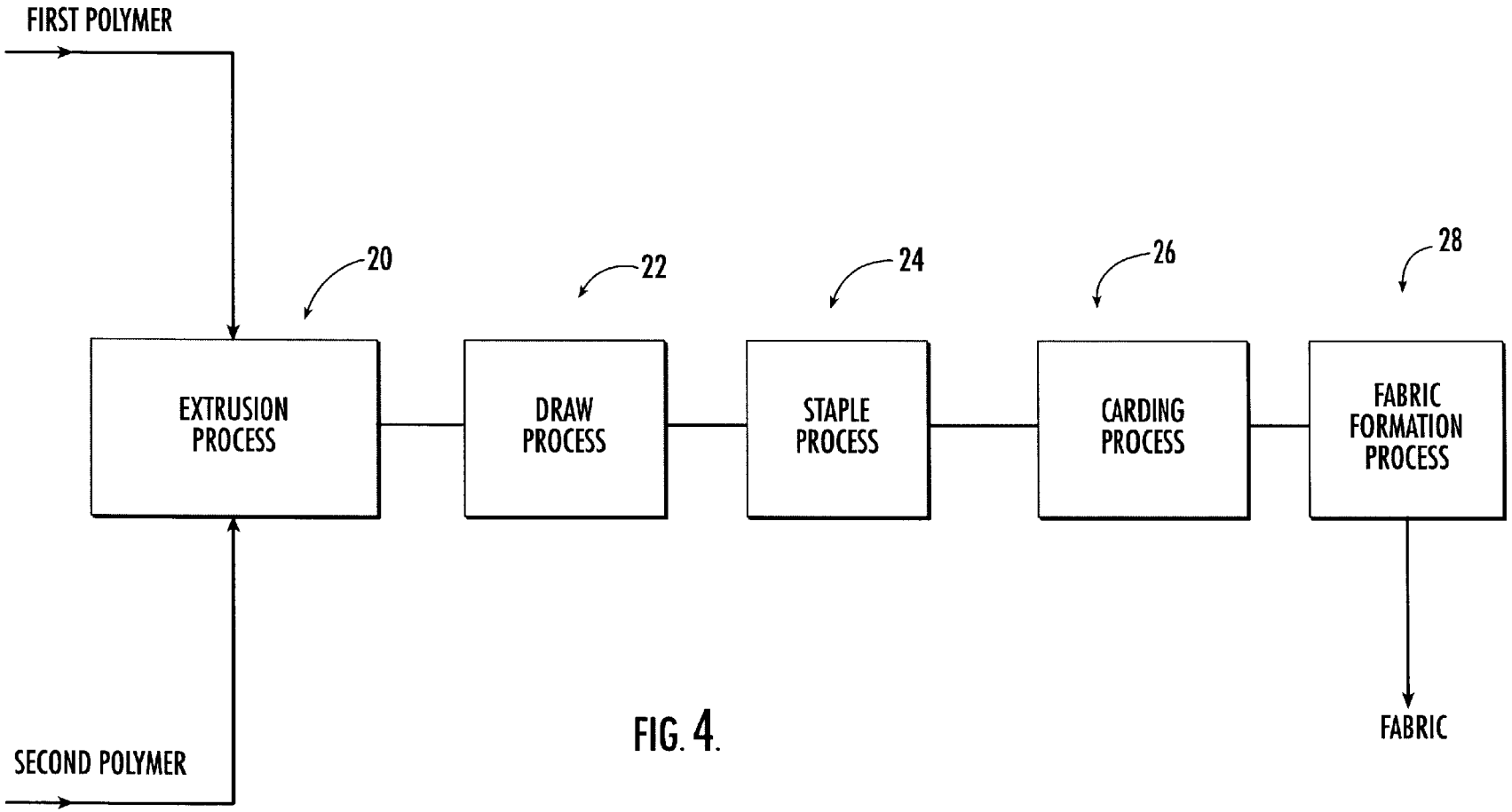
Figure 5:
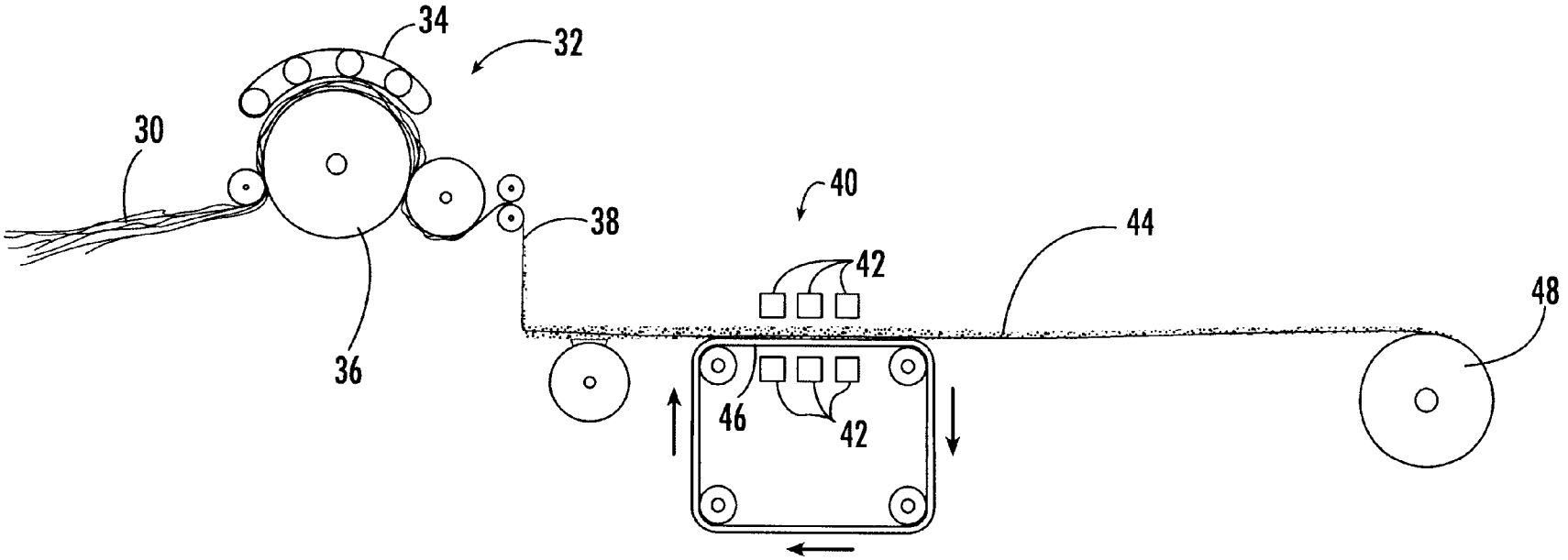
Figure 6:
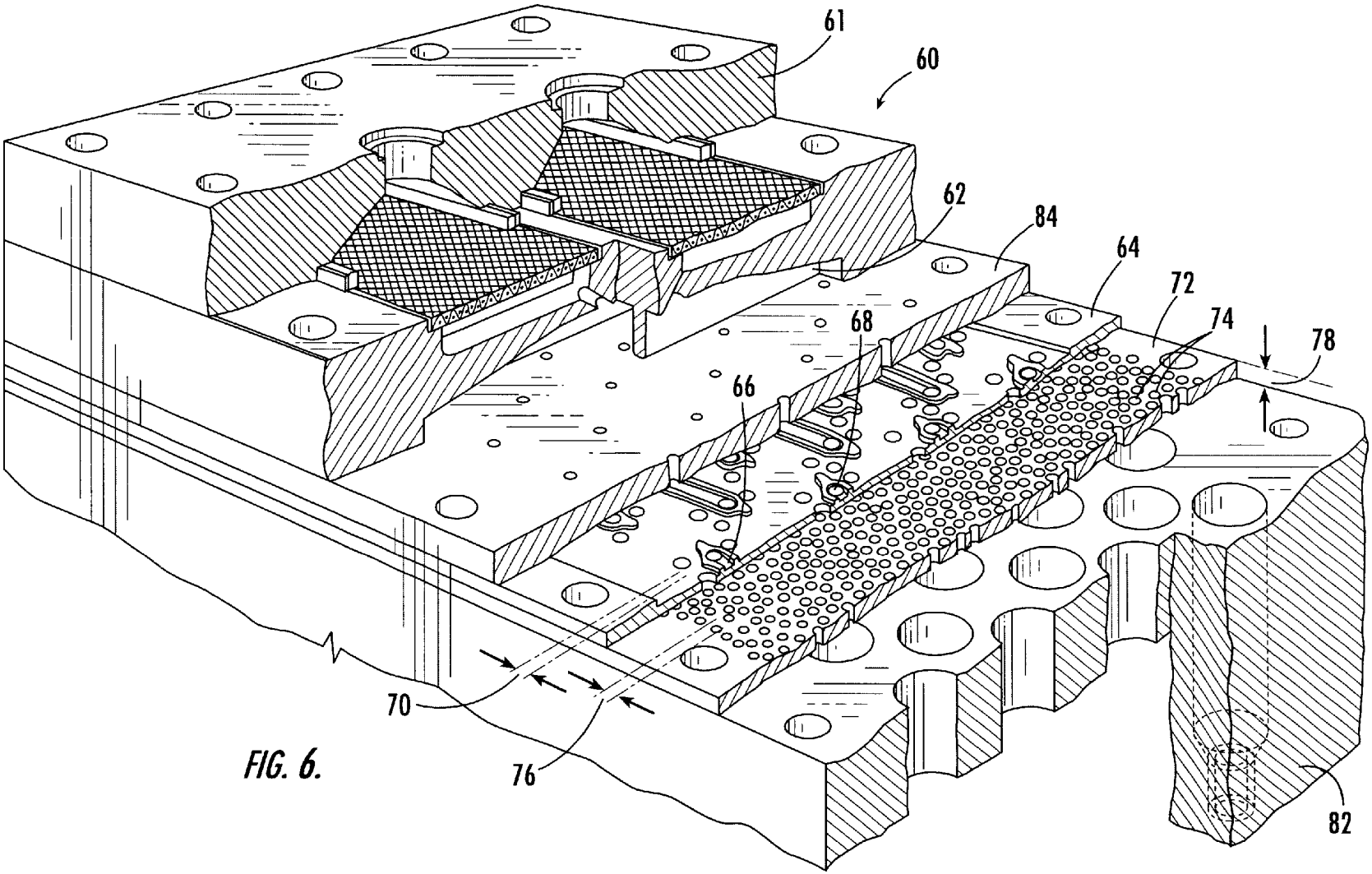
Figure 7:
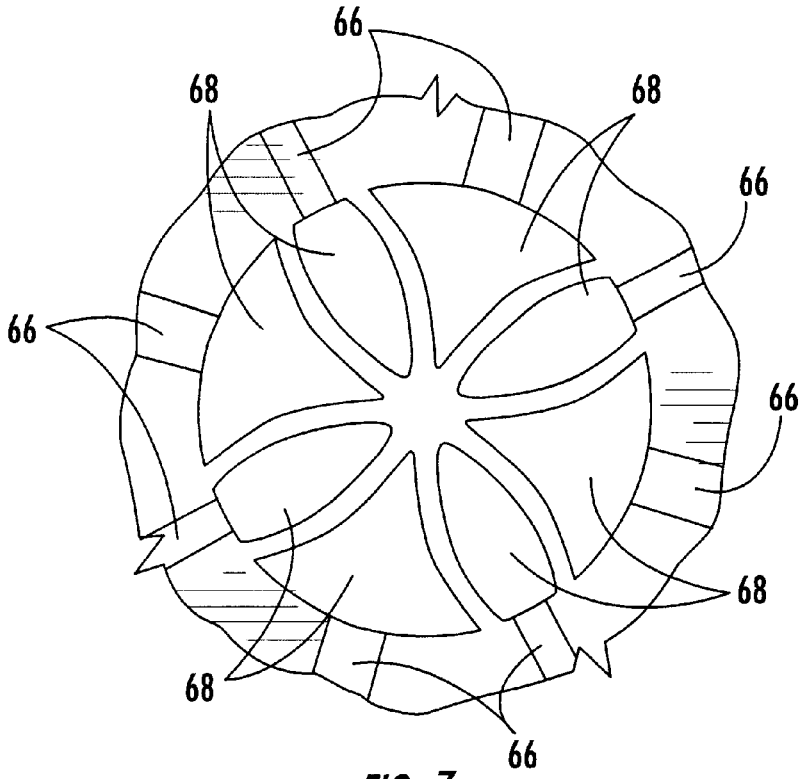
Figure 8:
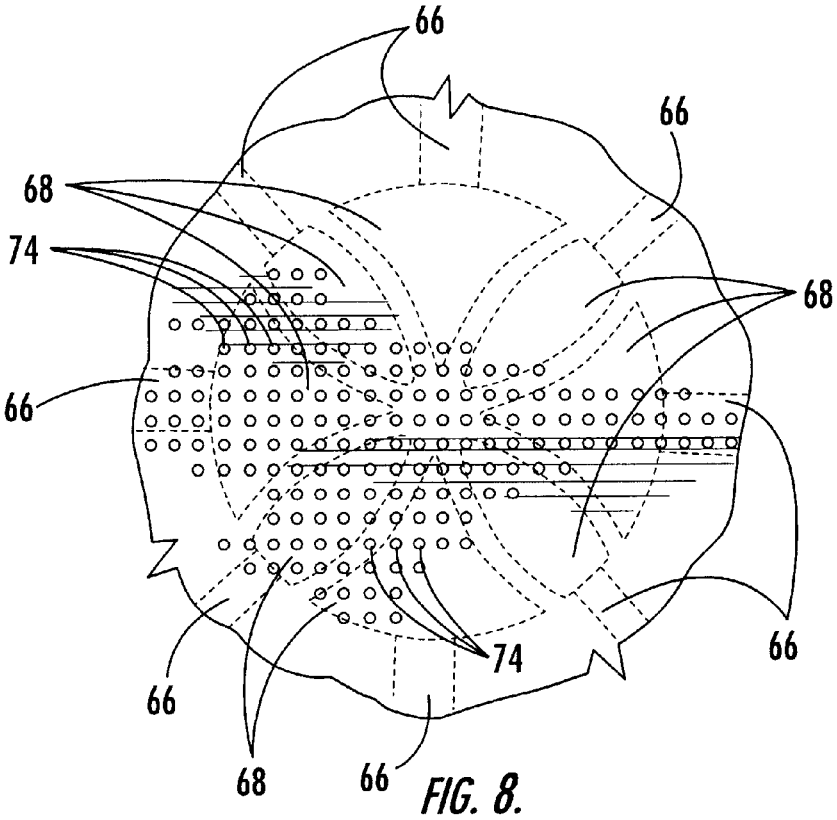
Figure 9:
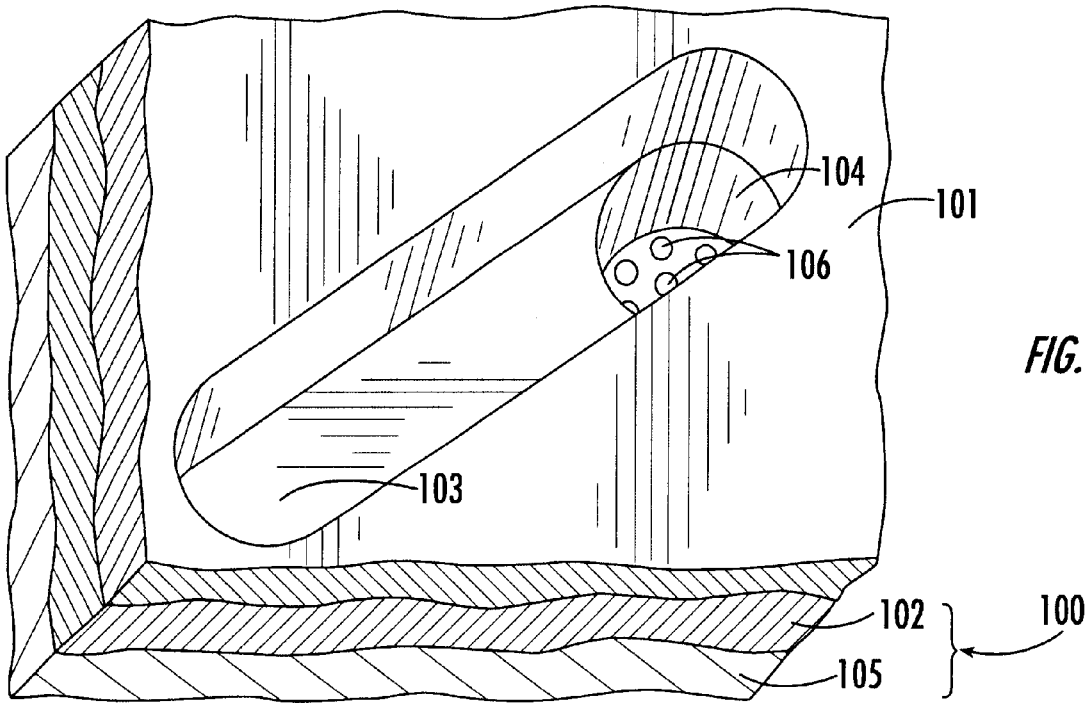
Figure 10:
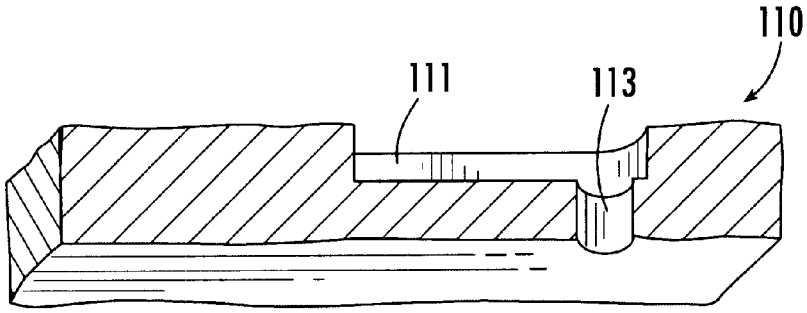
Figure 11:
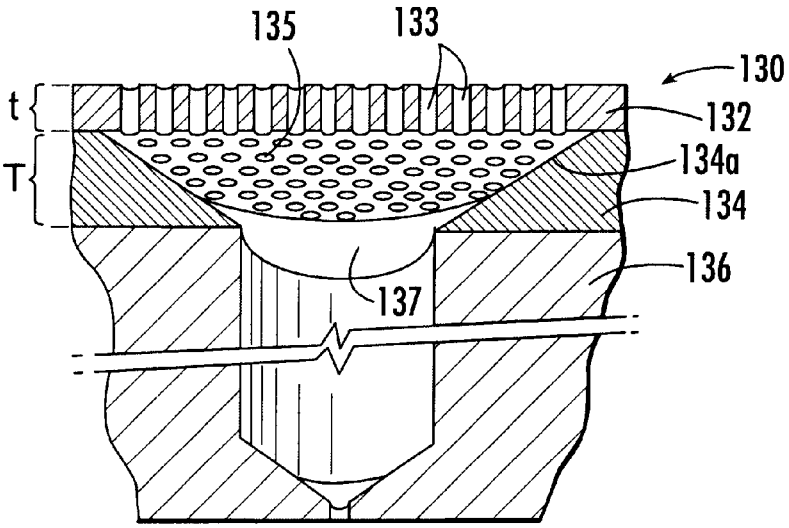
Figure 12:
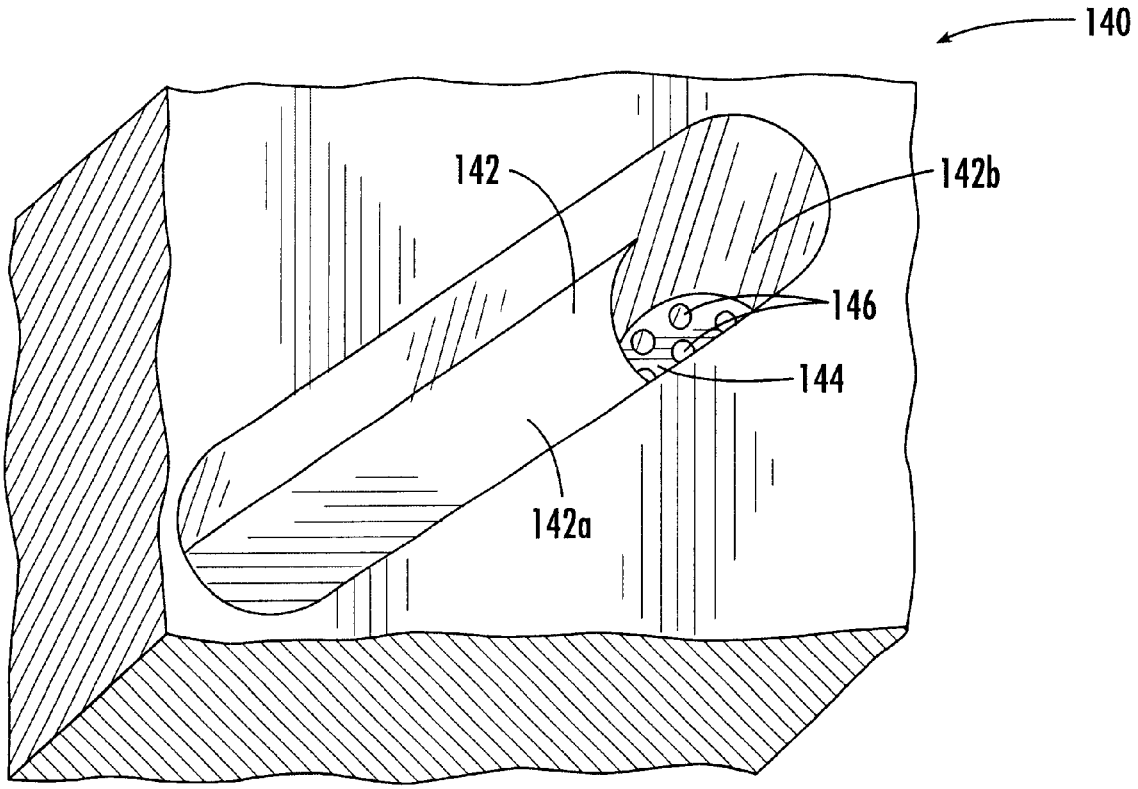

Having thus described the invention in general terms, reference will now be made to the accompanying drawings, which are not necessarily drawn to scale, and wherein:

FIGS. 1A–1E are cross-sectional views of exemplary multicomponent fibers in accordance with the present invention having partially overlapping or partially occluded segments;

FIGS. 2A–2D are cross-sectional views of various prior art multicomponent fibers having non-occluded segments or completely encapsulated or occluded segments;

FIGS. 3A and 3B are cross-sectional and longitudinal perspective views, respectively, of an exemplary dissociated fiber in accordance with the present invention;

FIG. 4 is a flow diagram illustrating generally a fabric formation process in accordance with another aspect of the present invention;

FIG. 5 schematically illustrates one particularly advantageous fabric formation process of the invention;

FIG. 6 is a perspective view of a synthetic fiber forming apparatus useful in accordance with the present invention;

FIG. 7 is a top view of a distribution plate which can be used in the present invention, which could be used to produce a fiber like that shown in FIG. 1A;

FIG. 8 is a top view of a metering plate which can be used in the present invention, with the material flow paths and shaped exit holes of the distribution plate shown in FIG. 7 appearing in dashed lines as they would overlie the metering plate;

FIG. 9 is a perspective top view of an alternative distribution/metering plate embodiment;

FIG. 10 is a cross-sectional view of an alternative embodiment of the distribution plate shown in FIG. 9, with the distribution plate being in the form of a single plate rather than plural plate sections;

FIG. 11 is a cross-sectional view of a further alternative arrangement for the junction of a metering plate with a spinneret which can be used in the instant invention; and FIG. 12 illustrates an embodiment of the invention similar to that shown in FIG. 9, with the distribution plate and metering plate being integrally formed as a single unit.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1A–1E illustrate cross-sectional views of exemplary multicomponent fibers of the present invention. The multicomponent fibers of the invention, designated generally as 4, include at least three structured polymeric components, at least one or more first components or segments 6, formed of a first polymeric composition, and at least one or more second components or segments 8, formed of a second polymeric composition that is different from the polymeric composition of the first segment(s).

In general, multicomponent fibers are formed of two or more polymeric materials which have been extruded together to provide continuous polymer segments which extend down the length of the fiber. The term "fiber" as used herein means both fibers of finite length, such as conventional staple fiber, as well as substantially continuous structures, such as filaments, unless otherwise indicated.

As illustrated in FIGS. 1A–1E, the invention can include a wide variety of fiber configurations, so long as at least one polymeric segment (designated as 8) partially overlaps or partially occludes at least one adjacent polymeric segment (designated as 6) at the surface or periphery of the fiber, as indicated by the circled region in FIG. 1A. Further, at least a portion of the polymeric segment(s) that is partially overlapped or occluded by an adjacent segment is exposed on the surface of the fiber.

Advantageously the fibers of the invention include at least one polymeric segment that partially overlaps or partially occludes more than one adjacent polymeric segment, as shown in FIGS. 1A–1D. The present invention, however, also includes fibers in which at least one polymeric segment partially overlaps only one adjacent polymeric segment, as illustrated in FIG. 1E.

As shown in FIGS. 1A and 1B, the fibers can have a substantially circular cross-sectional shape with multiple polymeric segments in a "pie/wedge" type configuration. The pie/wedge fibers can be non-hollow fibers (FIG. 1A) or hollow fibers (FIG. 1B). In particular, FIGS. 1A and 1B illustrate multicomponent fibers having eight alternating polymeric components or segments 6 and 8. Because segments 8 partially overlap adjacent segments 6, the segment interfaces are not perpendicular to the periphery of the fiber surface. Thus the "wedges" 6 can be described as having a petal or leaf shape, in contrast to a conventional pie/wedge fiber in which the segment interfaces are perpendicular to the periphery of the fiber and the resultant wedges are triangular. The skilled artisan will appreciate that the fibers of the invention can include more or less than eight segments.

Other fiber configurations may be used. For example, as shown in FIG. 1C, the fibers may include polymeric segments arranged as a matrix 8 and multiple segments 6 partially encased or enclosed in the matrix 8. In accordance with the invention at least a portion of the segments 6 is exposed at the fiber surface. In addition, segments 6 of the fiber of FIG. 1C can also be described as having a petal or leaf shape, although other shapes may also be used, so long as at least a portion of the partially enclosed segments 6 is exposed at the surface of the fiber.

FIG. 1D illustrates yet another fiber in accordance with the invention in which the fiber has a substantially rectangular cross-sectional configuration and further includes alternating segments 6 and 8 arranged as "slices." FIG. 1E illustrates a fiber with a circular cross-sectional shape and alternating polymer segments having a modified petal shape resulting from segments 8 overlapping one but not both adjacent edges of segments 6.

As illustrated in FIG. 1A–1E, the polymeric segments 6 have a generally regular shape. In addition, the polymer segments of the fibers of the invention do not substantially project or extend from the surface of the fiber.

As used herein the term "partially overlapping" or "partially occluded" refers to fiber configurations in which at least one polymeric component partially overlaps at least one adjacent polymeric segment at the surface or periphery of the fiber. In addition, the term "partially" indicates that the polymer segment that is overlapped by an adjacent polymer segment is not completely encased or encapsulated by the overlapping segment, but rather at least a portion thereof is exposed to the surface of the fiber. Thus the fibers of the invention include polymer segment interfaces that intersect the periphery of the fiber at an angle other than 90 degrees. As a result, at least a part of the overlapping polymer segment at the fiber surface is defined by an acute angle, while the overlapped polymer segment will include at least one portion at the fiber surface defined by an obtuse angle. The degree or percentage of overlap (designated as "o" in FIG. 1A) can vary and advantageously ranges from about 5% to about 90% of the length of a portion of the fiber circumference between opposing edges or boundaries of the overlapped segment projected perpendicular to the fiber periphery (designated as "w" in FIG. 1A). When a polymeric segment is partially overlapped by more than one adjacent segment, the total amount of overlap "o" is preferably no greater than 90% of "w."

Figure 2A:
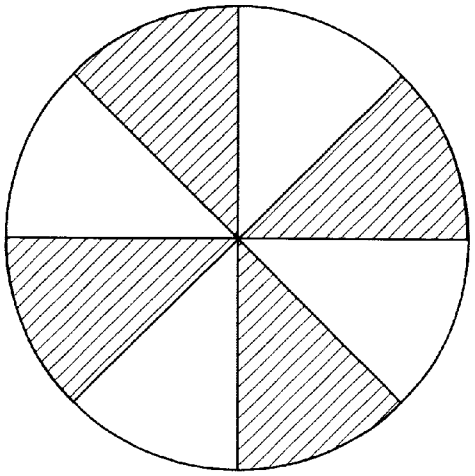
Figure 2B:
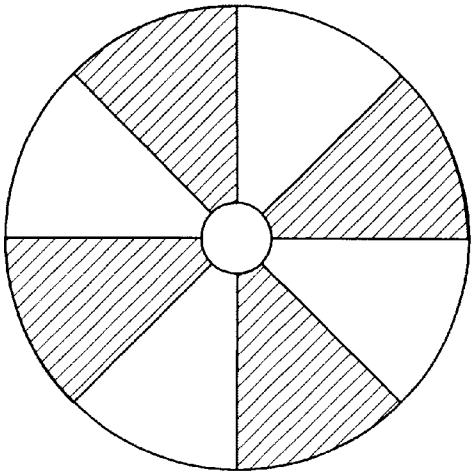
Figure 2C:
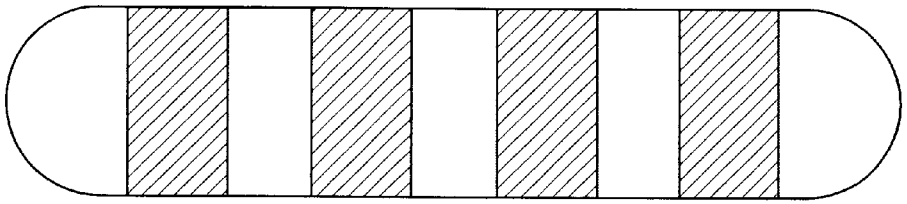

Surprisingly the inventors have found that contrary to conventional thinking in the fiber industry, the fibers of the invention can be readily dissociated by mechanical action, such as hydroentangling processes, despite the partial occlusion of at least one segment. In contrast to the present invention, conventional multicomponent fibers intended to be dissociated, particularly by mechanical means, included polymeric segments arranged relative to one so as to form distinct unocclusive cross-sectional segments along the length of the fiber so that none of the components are physically impeded from being separated. This was believed necessary to allow the segments to readily dissociate and form microfibers. Examples of conventional multicomponent fibers are illustrated in FIGS. 2A–2D. For example, FIGS. 2A and 2B illustrate conventional non-hollow and hollow pie/wedge arrangements, respectively. FIG. 2C illustrates a segmented rectangular fiber configuration. In each of these prior art fiber constructions the polymeric segments are non-occluded or do not overlap. Stated differently the polymeric component or segment interfaces are perpendicular to the fiber periphery.

Figure 2D:
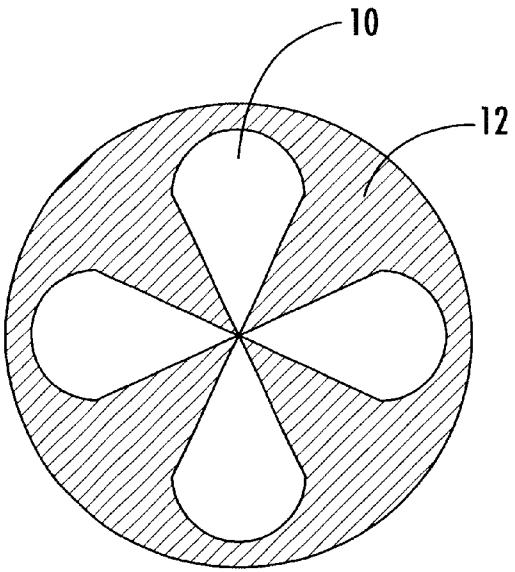

In contrast also to the fibers of the present invention in which the polymeric segments can partially overlap, FIG. 2D illustrates a fiber known in the art in which polymeric segments are completely or fully occluded. Stated differently the fiber includes a distinct polymeric segment(s) 10 completely encapsulated or surrounded by a matrix polymeric material 12 so that the segments 10 are not exposed on the surface of the fiber. Typically the matrix material 12 is soluble in water or solvent so that the matrix can be removed by dissolution. Alternatively the matrix material is made brittle so the fiber will split upon mechanical action. While this fiber can be mechanically dissociated, this type of configuration does not readily mechanically dissociate and in fact requires the use of specialty polymers, which can be expensive, brittle, difficult to extrude and further may not provide the desired properties for the end applications. In addition, the use of brittle polymers can be problematic because of dust generated during mechanical splitting.

Generally the polymer components of the fibers of the invention are chosen so as to be mutually incompatible, that is the polymer components do not substantially mix together or enter into chemical reactions with each other. Thus, when spun together to form a composite fiber, the polymer components exhibit a distinct phase boundary between them so that substantially no blend polymers are formed, preventing dissociation. In addition, the polymer compositions can provide a balance of adhesion/incompatibility between the components of the composite fiber. In this regard, the components can adhere sufficiently to each other to allow formation of a unitary unsplit multicomponent fiber, which can be subjected to conventional textile processing such as carding, winding, twisting, weaving, or knitting without any appreciable separation of the components until desired (for example, until hydroentangling treatment as described in more detail below). Conversely, the polymers should be sufficiently incompatible so that adhesion between the components is sufficiently weak, thereby allowing ready separation upon the application of sufficient mechanical action such as that provided during hydroentangling.

Thus the polymer compositions of components or segments 6 and 8 are selected so that the polymer segments readily dissociate or split from one another upon sufficient mechanical action. One advantage of the fibers of the invention is that the partially overlapping segmented fibers can withstand mechanical action such as that applied to fibers during carding processes so that the fibers remain substantially intact until directed to additional downstream processing. However, when sufficient mechanical action is applied to the fibers, for example during a hydroentanglement process, the fibers can then split.

Suitable polymers useful in the practice of the present invention include without limitation polyolefins, including polypropylene, polyethylene, polybutene, and polymethyl pentene (PMP), polyamides, including nylon 6, polyesters, including polyethylene terephthalate, polyethylene naphthalate, polytrimethylene terephthalate, poly(1,4-cyclohexylene dimethylene terephthalate) (PCT), and polylactic acid (PLA), thermoplastic elastomers, polyacrylonitrile, acetals, fluoropolymers, co- and terpolymers thereof and mixtures thereof. Generally substantially insoluble polymers are used, i.e., the fibers do not rely upon dissolution of a polymeric segment to form microfilaments. Exemplary combinations of polymers for multicomponent fibers include polyester and polypropylene, polyester and polyethylene, polyamide and polypropylene, polyamide and polyethylene, and polyamide and polyester.

Each of the polymeric components can optionally include other components not adversely effecting the desired properties thereof. Exemplary materials which could be used as additional components would include, without limitation, pigments, antioxidants, stabilizers, surfactants, waxes, flow promoters, solid solvents, particulates, and other materials added to enhance processability of the first and the second components. These and other additives can be used in conventional amounts.

The weight ratio of the components or segments can vary. Preferably the weight ratio is in the range of about 10:90 to 90:10, more preferably from about 20:80 to about 80:20, and most preferably from about 35:65 to about 65:35. The multicomponent fibers of the invention can be provided as staple fibers, continuous filaments, meltblown fibers, or spunbonded filaments.

In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a higher denier indicates a thicker or heavier fiber, as is known in the art.

Dissociation or splitting of the multicomponent fibers provides a plurality of fine denier filaments or microfilaments, each formed of one of the different polymer components of the multicomponent fiber. As used herein, the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament.

FIGS. 3A and 3B illustrate cross sectional and longitudinal perspective views of an exemplary multicomponent fiber (such as that of FIG. 1A) of the present invention that has been separated into a fiber bundle 14 of microfilaments as described above. In the illustrated example, the multicomponent fiber has been divided into four microfilaments 6 of a first polymer composition and four microfilaments 8 of a second polymer composition, thereby providing an eight filament fiber bundle. In a typical example, a multicomponent fiber having 4 to 48 segments can provide 4 to 48 microfi laments.

Also as illustrated FIGS. 3A and 3B, the resultant microfilaments assume the shape of the respective polymeric segments from which the microfilaments are derived. As a result, one or more of the microfilaments generally will have at least one or more substantially curved or rounded edges. Specific examples of microfilament shapes include leaf or petal shapes (such as those derived from fibers as illustrated in FIGS. 1A–C and 1E) and substantially rectangular shapes in which the corners of the rectangles are rounded (such as those derived from a fiber as illustrated in FIG. 1D).

The multicomponent fibers of the present invention may be dissociated into separate microfilaments of different polymeric compositions by any means that provides sufficient flex or mechanical action to the fiber to fracture and separate the components of the composite fiber. As used herein, the terms "splitting," "dissociating," or "dividing" mean that at least one of the fiber components is separated completely or partially from the original multicomponent fiber. Partial splitting can mean dissociation of some individual segments from the fiber, or dissociation of pairs or groups of segments, which remain together in these pairs or groups, from other individual segments, or pairs or groups of segments from the original fiber. As illustrated in FIGS. 3A and 3B, the fine denier components can remain in proximity to the remaining components as a coherent fiber bundle 14 of fine denier microfilaments 6 and 8 of different polymer compositions. However, as the skilled artisan will appreciate, in some processing techniques, such as hydroentanglement, or where the fibers are split prior to fabric formation, the fibers originating from a common fiber source may be further removed from one another. Further, the terms "splitting," dissociating," or "dividing" as used herein also include partial splitting.

Turning now to FIG. 4, an exemplary process for making a fabric in accordance with one embodiment of the invention is illustrated. Specifically, FIG. 4 illustrates an extrusion process 20, followed by a draw process 22, a staple process 24, a carding process 26, and a fabric formation process 28.

The extrusion process 20 for making multicomponent continuous filament fibers is well known. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired overall fiber cross-section (e.g., round, oval, etc.). Such a process is described, for example, in Hills U.S. Pat. No. 5,162,074, the contents of which are incorporated herein by reference in their entirety. When using the Hills apparatus and process, polymer compositions having differential viscosities are selected and spinning temperatures utilized so that one polymer (the low viscosity polymer) flows more readily and is able to wrap the other, higher viscosity polymer.

Alternatively, the spinneret configuration can be modified to allow the use of polymers having similar viscosities. An exemplary apparatus is described, for example, in copending U.S. application Ser. No. 09/137,435, filed Aug. 20, 1998, the entire disclosure of which is hereby incorporated by reference. Generally this modified apparatus can be described as follows.

FIG. 6 is a perspective view of a synthetic fiber forming apparatus 60 for forming a variety of synthetic fibers according to the instant invention. The upper material supply portion of the apparatus 60 can be formed in a conventional manner. For example, the supply portion of the apparatus 60 can include a conventional-type top plate 61 which receives one or more materials through inlet bores and transfers the material to a screen support plate 62, which filters the flowable material and forwards it towards a distribution plate.

As illustrated, the apparatus 60 desirably includes a distribution plate 64 which has at least one flow path 66 oriented in a direction perpendicular to the spinning direction and at least one exit hole 68. The apparatus 60 also includes a metering plate 72 which has at least one orifice 74 which desirably extends in a direction substantially parallel to the spinning direction, and a common flow path with at least one exit hole of the distribution plate 64. For example, in the apparatus 60, the metering plate 72 is positioned downstream of the distribution plate 64 such that plural orifices 74 of the metering plate 72 are immediately downstream of each of the distribution plate exit holes 68. The orifices 74 in the metering plate 72 are adapted to moderate the pressure of a material flowing from an exit hole of the distribution plate through the metering plate. For example, the diameter of at least a portion of the metering plate orifice 74 (shown at 76) is desirably smaller than the diameter of the distribution plate exit hole 68 (shown at 70) such that it moderates the pressure of a material flowing from the distribution plate 64 through the metering plate 72, to thereby provide a flow of material to a downstream spinneret 82 at a relatively more consistent pressure. For example, the exit holes 68 of the distribution plate 64 can be about 0.6 mm in diameter, while the exit holes of a mating metering plate 72 could be about 0.2 mm in diameter. While throughout the specification and claims it is described that the metering plate feeds flowable material to the backholes of a spinneret, it is noted that this is to include set-ups where the metering plate directly feeds the spinneret, and those where it feeds a transition plate which in turn feeds the spinneret backholes, as will be discussed further herein.

The distribution and metering plates 64, 72 can be made using any known shaping means including, but not limited to, etching, electroforming, laser-cutting, milling, LIGA-technique, casting, stamping, punching, drilling or otherwise machining, molding, engraving, reaming, or the like. The distribution plate holes 68 are "shaped" (i.e., non-circular) in order to produce multicomponent fibers of the invention having selectively shaped regions of specific components as described above. Similarly, the flow paths 66 can assume any configuration chosen by the plate designer to achieve the desired fiber shape, composition and cross-section, and can be of greater complexity than practicable using prior art spin pack assemblies, as will be readily recognized by those having ordinary skill in the art.

In a preferred form of the invention, the diameter of each of the metering plate orifices 74 is consistent along the length of the orifice (i.e., through the entire thickness of the metering plate.) Alternatively, a downstream or outlet end of the exit orifice 74 could be formed to have a smaller diameter than that of the downstream end of the exit hole of the distribution plate 64, to thereby provide a pressure increase to flowable material flowing therethrough. As a further alternative, the diameter of the orifices 74 of the metering plate can have a narrowed diameter between its upstream and downstream ends to form a neck.

In certain embodiments of the present invention, the thickness 78 of the metering plate 72 and/or the diameter of the metering plate orifices 74 are sized sufficiently to moderate the pressure on the flowable material stream through the metering plate orifice 74, thereby providing a flowable material stream with a determinable pressure to the spinneret 82. In a further aspect of the present invention, the metering plate orifice 74 orients a flowable material stream to produce an oriented flowable material stream for output to the spinneret 82.

The metering plate 72 of the apparatus 60, shown in more detail in FIG. 8, desirably has a plurality of orifices 74. The metering plate 72 is constructed such that plural orifices 74 of the metering plate correspond to one or more of the exit holes 68 of the distribution plate 64, as shown, for example, in FIG. 8. Each orifice 74 of the plurality of orifices 74 is desirably smaller than the corresponding distribution plate exit hole 68, although other orifice designs can be used within the scope of the invention, as discussed above. A spinneret 82 is desirably positioned downstream of the metering plate 72 such that the plurality of orifices 74 deliver a plurality of flowable material streams to one or more backholes 80 thereof. The metering plate can be in the form of a conventional punched, stamped, milled, laser-cut, drilled, reamed, etched or otherwise machined plate, can be made by casting, molding, or LIGA process, engraving or electroforming or can be in the form of a screen formed of fibers, filaments, wires, or the like. For example, a mesh screen having about 125 holes per inch could be used to meter the flowable material through the apparatus of the instant invention. Alternatively, the metering plate can be made by selectively plugging holes in an existing plate or screen. As will be recognized by those having ordinary skill in the art, the dimensions of the orifices, number of orifices adapted to correspond to each of the distribution plate exit holes, shape of the orifices, etc. will be selected to provide the desired degree of metering for the particular desired fiber construction to be produced. For example, for the arrangement illustrated in FIG. 8, it may be desirable to have as many as 60 orifices in the metering plate corresponding to the single petal shaped exit hole in the distribution plate.

In a further aspect of the invention, the size of each orifice 74 of the metering plate 72 and the thickness 78 of the metering plate 72 across its width are designed so that the pressure of any single stream of flowable material of the plurality of flowable material streams is substantially equilibrated to the pressure of any other stream of the plurality.

In an embodiment of the invention which is particularly well-suited for the production of multi-component fibers, the distribution plate 64, illustrated in FIG. 7, has at least two flow paths 66 which are designed to feed to a single spinneret backhole (i.e., flowable material exiting from several of the exit holes 68 is designed to ultimately feed to a single spinneret backhole). In this embodiment, the pressure increase through any one of the orifices 74 of the metering plate 72 is sufficiently large in comparison to the difference in pressure drop between the flow paths 66, to thereby produce a plurality of flowable material streams in which the pressure of each material stream is substantially equilibrated to the pressure of any other material stream of the plurality. The pressure increase through the metering orifices is also desirably greater than the pressure required to fill the shaped distribution plate exit hole, so this shaped area is filled before material flows steadily through the metering orifices. This insures that flowable material flows consistently through all the metering orifices downstream of each of the shaped exit holes. The substantially equilibrated, highly consistent material streams of the present invention provide an enhanced level of control over the resulting fiber cross sections. For example, the distribution plates employed in the present invention are capable of producing subtle or intricately shaped multicomponent fibers, such as fibers containing partially overlapping polymer segments.

It is understood that the apparatus of the current invention can be used to form a variety of different synthetic fibers. For illustration purposes, FIG. 1A shows the cross-sectional dimension of a synthetic fiber which is exemplary of one which might be formed by the synthetic fiber forming apparatus 60. In the production of this fiber, the synthetic fiber forming apparatus 60 has a distribution plate 64 which has shaped exit holes 68 which approximate the cross-sectional shape of the fiber to be produced. The shapes of the exit holes 68 are designed such that their combined shape roughly approximates the cross-sectional shape of the desired synthetic fiber. In the embodiment illustrated, the cross-sectional shape of the fiber includes a four petal configuration, as discussed above. However, as will be clear to those skilled in the art, the invention will have applicability to fibers of many different shapes other than the one specifically described for purposes of illustration of the invention.

In this configuration, the flow paths 66 distribute flowable material to the distribution plate shaped exit holes 68 where, due in part to the metering action of the downstream metering plate 72, the flowable material roughly fills the cross-sectional dimension of each of the distribution plate exit holes 68. The distribution plate exit holes 68 produce and distribute shaped, flowable material streams to the plurality of orifices 74 of the metering plate 72, which is desirably positioned beneath the distribution plate 64.

In the embodiment of the invention illustrated in FIGS. 7–8, the plurality of orifices 74 of the metering plate 72 receive the shaped material stream and output a plurality of material streams which collectively substantially maintain the predetermined shape as illustrated for example in FIG. 1A as segments 6 and 8. Because the material may have traveled through flow paths of various different lengths on the distribution plate, the material streams which exit the distribution plate 64 may be at varying pressures. Because all of the streams are then caused to travel through the metering plate 72, each of the streams which emerges from the metering plate tends to emerge at a pressure which approximates that of each of the other material streams. The streams emerge from the metering plate 72 in a configuration approximating that desired for the spun fiber, and are fed into the backhole of the spinneret.

In operation, the process involves the step of directing a flow of material across a distribution plate 64, and thereafter through at least one exit hole 68 to an adjacent metering plate 72 having multiple downstream orifices 74 which act to meter the flow of the material therethrough. In embodiments where the metering plate is used simply to balance the pressures between individual streams rather than maintain a specific shape imparted by a shaped exit hole, it will be appreciated that a single metering hole could be used to correspond with each of two or more exit holes to meter the flow of a material flowing therethrough and substantially equilibrate the flow of each of the respective flowable material streams. Preferably, the metering plate is positioned immediately downstream of the distribution plate, though it is to be noted that one or more plates could be positioned intermediate the distribution plate 64 and the metering plate 72. In other words, the word "thereafter" is used to define that the metering plate is located in the spinning arrangement at a position downstream of one or more distribution plates in order to increase the equilibration and/or improve the pressure of one or more flowable material streams subsequent to travel through a distribution plate and prior to entering the backhole of the spinneret. As noted above in the discussion of the apparatus, the orifice in the metering plate is desirably relatively smaller than the exit hole 68 in the distribution plate, as the arrangement has been found to effectively moderate and control the pressure of the flowable material. Thereafter the moderated pressure flowable material from the downstream end of the orifice 74 is directed to a spinneret 82. In alternate embodiments, the directing step comprises either directing a flowable material or a shaped, flowable material stream into a plurality of orifices 74 in a metering plate 72, and thereafter to a spinneret 82.

Thus, the process of the present invention can serve to equilibrate the pressure of the flow of the plurality of flowable materials, thereby producing more uniform fibers. The process of the present invention is further beneficial in that more subtle, or intricate, component shapes, such as partially overlapping cross-sections, can be achieved. In certain embodiments of the present invention, the pressure created by the metering plate 72 can be sufficient to operate the spinning process, thereby obviating the need for a conventional metering plate upstream of the distribution plate 64. Alternatively, a second metering plate 84 can be provided upstream of the distribution plate 64, to feed the material to the distribution plate 64 at an initially equilibrated pressure, with the downstream metering plate 72 securing, among other things, to reduce pressure irregularities imparted between the upstream metering plate 84 and the downstream metering plate.

FIG. 9 illustrates an alternative distribution/metering plate arrangement useful in performing the instant invention. In this embodiment, a distribution plate, shown generally at 100, directs a flowable material from an upstream supply source (not shown) to a downstream metering plate 105 having a plurality of exit orifices 106. The distribution plate 100 is provided as two separate plate sections: in the illustrated embodiments the first plate section 101 includes a channel 103 which extends through its full thickness to define a flow path in the distribution plate, while a second plate section 102 includes an opening 104, which forms the exit hole of the distribution plate. The respective distribution plate sections 101, 102 collectively define a flow path and exit hole arrangement similar to that provided by the single distribution plate 64 illustrated in FIGS. 6 and 7. The plate sections are preferably designed to fit closely together such that material flowing though the channel 103 and opening 104 does not have a tendency to seep between the plate sections. Furthermore, the plate sections 101, 102 can be specially configured to facilitate their tight securement together (e.g., by forming one of the plate sections with a protrusion and the other with a mating depression, such that the plate sections are properly aligned relative to each other, the protrusion and depression are mated together). A metering plate 104 is positioned immediately downstream of the distribution plate 100, and includes a plurality of orifices 106 in fluid flow connection with the orifice 104 in the second distribution plate section 102. These orifices 106 are adapted to regulate the flow of material therethrough and into the spinneret; in the illustrated embodiment, the orifices 106 are substantially smaller than the orifice 104 in the second distribution plate section, so that they act to meter the flow of material through the metering plate, as well as material through the distribution plate sections 101 and 102. While only a single distribution plate 100 and metering plate 105 are shown, it is noted that plural distribution and metering plates can be provided to achieve the fiber configuration desired.

It is to be noted that while for purposes of illustration the individual distribution plates have been depicted as separate elements, they can be integrally formed as a single unit within the scope of the instant invention. For example, FIG. 10 illustrates a distribution plate 110 designed to provide substantially the same flow path pattern as that shown in FIG. 9, through the use of a single plate having overlying flow path 111 and exit hole 113 portions of different configurations. In this way, the single distribution plate can provide substantially the same flow pattern as the dual plate system.

In the spinning assembly illustrated in FIG. 6, the metering plate 72 is positioned immediately upstream of the spinneret backholes, so that it feeds the flowable material stream directly into one or more of the spinneret backholes. However, a further alternative arrangement of the metering plate relative to the spinneret backholes useful in performing the instant invention is shown in FIG. 11. In this arrangement, shown generally at 130, a transition plate 134 is positioned intermediate the metering plate 132 and the spinneret 136. The transition plate 134 desirably includes an orifice 135 which is relatively larger than the backhole 137 of the spinneret, so as to effectively expand the diameter of the backhole. In this way, a greater number of exit holes 133 of the metering plate 132 can be directed to a single backhole 137, thereby enabling the production of fibers having even greater degrees of complexity. The orifice 135 of the transition plate is illustrated as having substantially tapered walls 134*a* which extend to the walls of the spinneret backhole. The orifice can be substantially conical or otherwise shaped so as to have a relatively wider diameter upstream (adjacent to the metering plate) and a relatively narrower diameter downstream (adjacent to the backhole of the spinneret). In addition, the transition plate 134 in this arrangement has a relatively large thickness T (for example, as shown compared with the thickness t of the metering plate) which enables a gradual combining of the plural material streams exiting the metering plate 132 and entering the backhole 137 of the spinneret 136.

FIG. 12 illustrates an alternative embodiment of the invention, in which the distribution plate 142 and downstream metering plate 144 are integrally formed as a single unit 140. Like the embodiments discussed above, the distribution plate 142 includes a flow path 142*a* and an exit hole 142*b* through which a flowable material can be output to a metering plate 144. The metering plate 144 portion of the unit 140 includes a plurality of orifices 146 which are in fluid flow connection with the distribution plate 142 portion of the unit, and are adapted to moderate the pressure of a flowable material flowing therethrough.

In yet another alternative metering plate structure similar to that illustrated in FIG. 8, orifices adapted to correspond to different flow paths in the distribution plate are differently configured to thereby differently moderate the pressure of flowable material flowing through the respective corresponding flow paths in the distribution plate. For example, the orifices can be differently sized, although it is noted that they could be differently shaped or otherwise differently configured to achieve the desired pressure moderation, within the scope of the instant invention.

Returning now FIG. 4, which schematically illustrates an exemplary process of the invention, a first polymer stream and a second polymer stream which is different from the first polymer stream are fed into the polymer distribution system. The polymers typically are selected to have melting temperatures such that the polymers can be spun at a polymer throughput that enables the spinning of the components through a common capillary at substantially the same temperature without degrading one of the components.

Following extrusion through the die, the resulting thin fluid strands, or filaments, remain in the molten state for some distance before they are solidified by cooling in a surrounding fluid medium, which may be chilled air blown through the strands. Once solidified, the filaments can be taken up on a godet or other take-up surface. In a continuous filament process, the strands are taken up on a godet that draws down the thin fluid streams in proportion to the speed of the take-up godet. Continuous filament fiber may further be processed into staple fiber. In processing staple fibers, large numbers, e.g., 10,000 to 1,000,000 strands, of continuous filament are gathered together following extrusion to form a tow for use in further processing, as is known in that art.

Rather than being taken up on a godet, continuous multicomponent fiber may also be melt spun as a direct laid nonwoven web. In a spunbond process, for example, the strands are collected in an air attenuator following extrusion through the die and then blown onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process 22. In the draw process the strands are typically heated past their glass transition point and stretched to several times their original length using conventional drawing equipment, such as, for example, sequential godet rolls operating at differential speeds. Draw ratios of 2 to 4 times are typical. Optionally, the drawn strands may be heat set, to reduce any latent shrinkage imparted to the fiber during processing, as is further known in the art.

Following drawing in the solid state, the continuous filaments can be cut into a desirable fiber length in a staple process 24. The length of the staple fibers generally ranges from about 25 to about 50 millimeters, although the fibers can be longer or shorter as desired. See, for example, U.S. Pat. No. 4,789,592 to Taniguchi et al. and U.S. Pat. No. 5,336,552 to Strack et al. Optionally, the fibers may be subjected to a crimping process prior to the formation of staple fibers, as is known in the art. Crimped composite fibers are useful for producing lofty woven and nonwoven fabrics since the microfilaments that split from the multicomponent fibers largely retain the crimps of the composite fibers and the crimps increase the bulk or loft of the fabric. Such lofty fine fiber fabric of the present invention exhibits cloth-like textural properties, e.g., softness, drapability and hand, as well as the desirable strength properties of a fabric containing highly oriented fibers.

The staple fiber thus formed is then fed into a carding process 26. A more detailed schematic illustration of a carding process is provided in FIG. 5. As shown in FIG. 5, the carding process can include the step of passing staple tow 30 through a carding machine 32 to align the fibers of the staple tow as desired, typically to lay the fibers in roughly parallel rows, although the staple fibers may be oriented differently. The carding machine 32 is comprised of a series of revolving cylinders 34 with surfaces covered in teeth. These teeth pass through the staple tow as it is conveyed through the carding machine on a moving surface, such as a drum 36. The carding process produces a fiber web 38.

Referring back to FIG. 4, in one advantageous embodiment of the invention, carded fiber web 38 is subjected to a fabric formation process to impart cohesion to the fiber web. In one aspect of that embodiment, the fabric formation process includes the step of mechanically bonding the fibers of fiber web 38 together to form a coherent unitary nonwoven fabric. The bonding step can be any mechanical bonding process known in the art. Typical methods of mechanical bonding include hydroentanglement and needle punching.

In a preferred embodiment of the present invention, a hydroentangled nonwoven fabric is provided. A schematic of one hydroentangling process suitable for use in the present invention is illustrated in FIG. 5. As shown in FIG. 5, a fiber web 38 is conveyed longitudinally to a hydroentangling station 40 wherein a plurality of manifolds 42, each including one or more rows of fine orifices, directs high pressure water jets through the fiber web 38 to intimately hydroentangle the staple fibers, thereby providing a cohesive, nonwoven fabric 44.

The hydroentangling station 40 is constructed in a conventional manner as known to the skilled artisan and as described, for example, in U.S. Pat. No. 3,485,706 to Evans, which is hereby incorporated by reference. As known to the skilled artisan, fiber hydroentanglement is accomplished by jetting liquid, typically water, supplied at a pressure of from about 200 psig up to 1800 psig or greater to form fine, essentially columnar, liquid streams. The high pressure liquid streams are directed toward at least one surface of the composite web. In one embodiment of the invention water at ambient temperature and 200 bar is directed towards both surfaces of the web. The composite web is supported on a foraminous support screen 46 which can have a pattern to form a nonwoven structure with a pattern or with apertures or the screen can be designed and arranged to form a hydraulically entangled composite which is not patterned or apertured. The fiber web 38 can be passed through the hydraulic entangling station 40 a number of times for hydraulic entanglement on one or both sides of the composite web or to provide any desired degree of hydroentanglement.

The fabric may be directed to additional downstream processing. Alternatively the fabric may be directed to a roll 48.

Optionally, the nonwoven webs and fabrics of the present invention may be thermally bonded. In thermal bonding, heat and/or pressure are applied to the fiber web or nonwoven fabric to increase its strength. Two common methods of thermal bonding are air heating, used to produce low-density fabrics, and calendering, which produces strong, low-loft fabrics. Hot melt adhesive fibers may optionally be included in the web of the present invention to provide further cohesion to the web at lower thermal bonding temperatures. Such methods are well known in the art.

In addition, rather than producing a dry-laid nonwoven fabric, an aspect of which was previously described, a nonwoven may be formed in accordance with the instant invention by direct-laid means. In one embodiment of direct laid fabric, continuous filament is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various patents, e.g., Buntin et al., U.S. Pat. No. 3,987,185; Buntin, U.S. Pat. No. 3,972,759; and McAmish et al., U.S. Pat. No. 4,622,259. The fiber of the present invention may also be formed into a wet-laid nonwoven fabric, via any suitable technique known in that art.

While particularly useful in the production of nonwoven fabrics, the fibers of the invention can also be used to make other textile structures, such as but not limited to woven and knit fabrics. Yarns prepared for use in forming such woven and knit fabrics are similarly included within the scope of the present invention. Such yarns may be prepared from continuous filaments or spun yarns comprising staple fibers of the present invention by methods known in the art, such as twisting or air entanglement.

In one advantageous embodiment of the invention, the fabric formation process is used to dissociate the multicomponent fiber into microfilaments. Stated differently, forces applied to the multicomponent fibers of the invention during fabric formation in effect split or dissociate the polymer components to form microfilaments. The resultant fabric thus formed is comprised, for example, of a plurality of microfilaments 6 and 8 shown in FIG. 3, and described previously. In a particularly advantageous aspect of the invention, the hydroentangling process used to form the nonwoven fabric dissociates the composite fiber. In other advantageous embodiments, needlepunching is used to simultaneously form the fabric and split the multicomponent fibers. In the alternative, the carding, drawing, or crimping processes previously described may be used to split the multicomponent fiber. Optionally, the composite fiber may be divided after the fabric has been formed by application of mechanical forces thereto. In particular, a separate splitting step is required for fabric formed by methods such as thermal bonding, meltblowing, weaving, and knitting. In addition, the multicomponent fiber of the present invention may be separated into microfilaments before or after formation into a yarn.

The fabrics of the present invention provide a combination of desirable properties including fabric uniformity, uniform fiber coverage, good barrier properties and high fiber surface area. The fabrics of the present invention also exhibit desirable hand and softness and can be produced to have different levels of loft.

The fabrics of the invention can be used in a variety of applications, including without limitation, filtration media, synthetic suede, and the like.

The present invention will be further illustrated by the following non-limiting example.

EXAMPLE 1

Bicomponent staple fibers were made by extruding BS700 nylon 6 from BASF and 0.55 i.v. PET polyester from Nan Ya Corporation from separate extruders through separate gear pumps and through a common spinneret pack designed to form a pie wedge cross section in a round fiber, comprising 8 segments of nylon alternating with 8 segments of polyester. The cross section formed wedge-shaped segments with polymer interfaces perpendicular to the fiber's circumference at the fiber surface (similar to the wedges illustrated in FIG. 2A). These fibers were taken up at a spinning speed of 1500 m/min and subsequently drawn in a two-stage drawing process to a final draw ratio of 3:1 to result in a linear density of 3 denier per filament. The drawn fibers were crimped and cut to 1.5 inches in length. In attempts to form hydroentangled fabrics from these fibers, so many of the fibers split in the carding process that carding was not able to efficiently form a web for hydroentangling.

EXAMPLE 2

Bicomponent fibers were made using a process and materials identical to those in Example 1, with the exception that the spinneret pack was configured to form a fiber cross section with 8 segments of nylon completely encapsulated by a thin wall of polyester at the fiber surface, said wall of polyester being contiguous with 8 alternating wedges of polyester, similar to the wedges illustrated in FIG. 2D. In attempts to form hydroentangled fabrics from these fibers, no problems with splitting in carding were encountered, but hydroentangling did not cause any noticeable splitting of the fibers.

EXAMPLE 3

Bicomponent fibers were made using a process and materials identical to those in Example 1, with the exception that the spinneret pack was configured to form a fiber cross section with 8 petal-shaped segments of nylon overlapped on both sides but not fully encapsulated by 8 alternating wedge-shaped segments of polyester, similar to the wedges illustrated in FIG. 1A. The polyester wedges overlapped the nylon wedges by about 50–70 percent, on average, using the formula previously described. In attempts to form hydroentangled fabrics from these fibers, no problems with splitting in carding were encountered and hydroentangling resulted in commercially-acceptable levels of splitting of the fibers, with about 60 to 70 percent of the fibers completely separated into 16 individual wedge- or petal-shaped segments.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A mechanically splittable multicomponent fiber comprising at least three polymeric segments and including:

a first polymeric segment formed of a first substantially insoluble polymer composition and having at least a portion thereof exposed on the outer peripheral surface of the fiber; and polymeric segments adjacent said first polymeric segment so that said first polymeric segment is disposed between said adjacent polymeric segments, wherein each of said adjacent polymeric segments is formed of a substantially insoluble polymer composition which is different from said first polymeric composition and each of said adjacent polymeric segments also having at least a portion thereof exposed on the outer peripheral surface of the fiber, wherein said first polymeric segment is arranged so as to partially overlap at least one of said adjacent polymeric segments at the outer peripheral surface of said fiber and to form a polymer segment interface between said first polymeric segment and at least one of said adjacent polymeric segments that intersects the outer periphery of the fiber at an angle other than 90 degrees.

2. The fiber of claim 1, wherein said first polymeric segment is arranged so as to partially overlap both of said adjacent polymeric segments at the surface of said fiber.

3. The fiber of claim 1, wherein said fiber has a substantially round cross-section and said adjacent polymeric segments have a substantially petal shaped cross-section.

4. The fiber of claim 3, wherein said fiber is hollow.

5. The fiber of claim 3, wherein said first polymeric segment is arranged as a matrix partially encapsulating said adjacent polymeric segments.

6. The fiber of claim 1, wherein said polymeric segments are formed of polymers selected from the group consisting of polyolefins, polyamides, polyesters, elastomers, and copolymers, terpolymers and blends thereof.

7. The fiber of claim 6, wherein at least one of said polymeric segments includes a polyolefin.

8. The fiber of claim 7, wherein said polyolefin is selected from the group consisting of polypropylene, polyethylene, polybutene, polymethyl pentene, and copolymers, terpolymers and blends thereof.

9. The fiber of claim 6, wherein at least one of said polymeric segments includes a polyester.

10. The fiber of claim 9, wherein said polyester is selected from the group consisting of polyethylene terephthalate, polyethylene naphthalate, polyethylene trimethylene terephthalate, poly(1,4-cyclohexylene dimethylene terephthalate) (PCT), and polylactic acid (PLA.

11. The fiber of claim 6, wherein at least one of said polymeric segments includes a polyamide.

12. The fiber of claim 11, wherein said polyamide is nylon 6.

13. The fiber of claim 1, wherein said fiber is a multicomponent fiber comprising alternating polymeric segments formed of polyamide and polyester polymers.

14. The fiber of claim 1, wherein said fiber is a multicomponent fiber comprising alternating polymeric segments formed of polyamide and polyolefin polymers.

15. The fiber of claim 1, wherein said fiber is a multicomponent fiber comprising alternating polymeric segments formed of polyester and polyolefin polymers.

16. The fiber of claim 1, wherein said fiber is selected from the group consisting of continuous filaments, staple fibers, meltblown fibers and spunbonded filaments.

17. The fiber of claim 1, wherein a part of said first polymeric segment overlapping said at least one adjacent polymeric segment at the outer peripheral surface of said fiber is defined by an acute angle, while a part of said at least one adjacent polymeric segment overlapped by said first polymeric segment at the outer peripheral surface of said fiber is defined by an obtuse angle.

18. The fiber of claim 17, wherein said first polymeric segment and said at least one adjacent polymeric segment form a degree of overlap ranging from about 5% to about 90% of the length of a portion of the fiber circumference between opposing edges of said at least one adjacent polymeric segment projected perpendicular to the outer peripheral surface of said fiber.

19. The fiber of claim 18, wherein said first polymeric segment is arranged so as to partially overlap both of said adjacent polymeric segments at the outer peripheral surface of said fiber and wherein the total amount of overlap is no greater than 90% of the length of a portion of the fiber circumference between opposing edges of said adjacent polymeric segments projected perpendicular to the outer peripheral surface of said fiber.

20. A mechanically splittable multicomponent fiber comprising at least three polymeric segments and including:

a first polymeric segment formed of a first substantially insoluble polymer composition and having at least a portion thereof exposed on the outer peripheral surface of the fiber; and polymeric segments adjacent said first polymeric segment so that said first polymeric segment is disposed between said adjacent polymeric segments, wherein each of said adjacent polymeric segments is formed of a substantially insoluble polymer composition which is different from said first polymeric composition and each of said adjacent polymeric segments also having at least a portion thereof exposed on the outer peripheral surface of the fiber, wherein said first polymeric segment is arranged so as to partially overlap at least one of said adjacent polymeric segments at the outer peripheral surface of said fiber and wherein said fiber has a substantially rectangular cross-section and said adjacent polymeric segments have a substantially rectangular cross-section.

21. A mechanically splittable multicomponent fiber comprising at least three polymeric segments and including:

a first polymeric segment formed of a first substantially insoluble polymer composition and having at least a portion thereof exposed on the outer peripheral surface of the fiber; and polymeric segments adjacent said first polymeric segment so that said first polymeric segment is disposed between said adjacent polymeric segments, wherein each of said adjacent polymeric segments is formed of a substantially insoluble polymer composition which is different from said first polymeric composition and each of said adjacent polymeric segments also having at least a portion thereof exposed on the outer peripheral surface of the fiber, wherein said first polymeric segment is arranged so as to partially overlap at least one of said adjacent polymeric segments at the outer peripheral surface of said fiber and wherein said fiber has a substantially round cross-section and said adjacent polymeric segments have a substantially petal shaped cross-section.

* * * * *